US005167454A

United States Patent [19]

Woods et al.

[11] Patent Number: 5,167,454

[45] Date of Patent: Dec. 1, 1992

[54] RECLOSABLE PLASTIC BAGS HAVING IMPROVED LIP SIDEWELDS AND METHOD OF MAKING SAME

[75] Inventors: Jamie M. Woods, Kawkawlin; Jose Porchia; Brian C. Dais, both of Midland, all of Mich.

[73] Assignee: Dowbrands L.P., Indianapolis, Ind.

[21] Appl. No.: 708,410

[22] Filed: May 31, 1991

[51] Int. Cl.[5] ..... B65D 30/10

[52] U.S. Cl. ..... 383/35; 264/177.1

[58] Field of Search ..... 383/35, 65, 107; 264/177.1, 177.16; 428/157, 163, 167

[56] References Cited

U.S. PATENT DOCUMENTS 3,393,861 7/1968 Clayton et al. ..... 383/35
3,411,698 11/1968 Reynolds ..... 383/35
4,076,121 2/1978 Clayton et al. ..... 264/177.1 X
4,363,345 12/1982 Scheibner ..... 383/35 X
5,009,828 4/1991 McCree ..... 264/177.1
5,011,642 4/1991 Welygan et al. ..... 264/177.1 X

FOREIGN PATENT DOCUMENTS 89680 9/1983 European Pat. Off. ..... 383/65
398731 11/1990 European Pat. Off. ..... 383/65

*Primary Examiner*—Stephen Marcus
*Assistant Examiner*—Jes F. Pascua

[57] ABSTRACT

A reclosable plastic bag including grip strips of a plurality of spaced apart ridges extending generally parallel to one another over the width of the bag on opposed lips of the bag, wherein the ridges are characterized in cross-section by a lower generally triangularly-shaped portion and by an upper bulbous portion defined generally at an apex of the lower generally triangularly-shaped portion.

5 Claims, 1 Drawing Sheet

Fig. 1
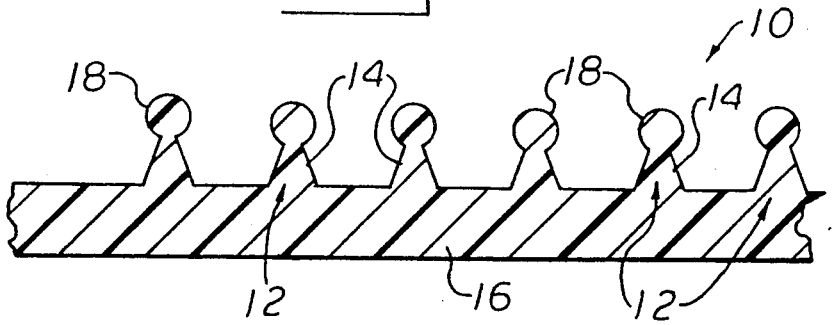
Fig. 2 (PRIOR ART)
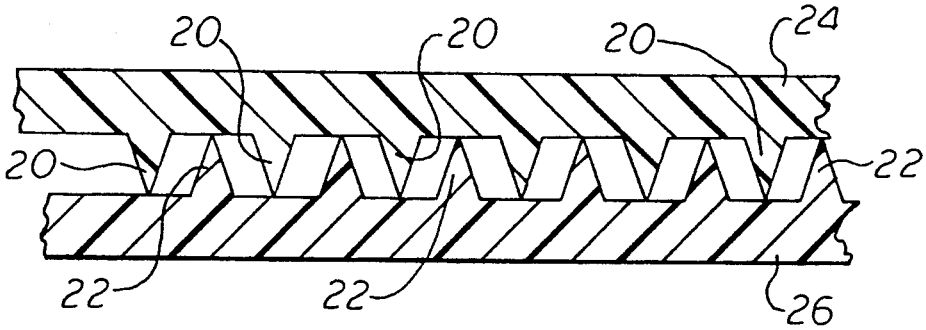
Fig. 3
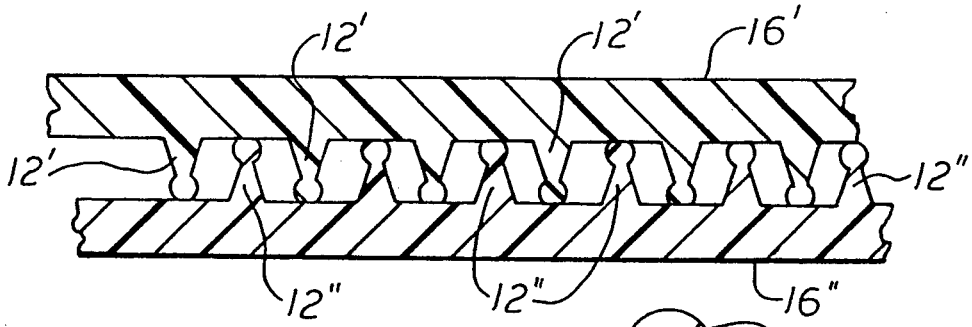
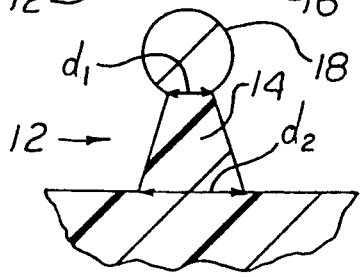
Fig. 4

RECLOSABLE PLASTIC BAGS HAVING IMPROVED LIP SIDEWELDS AND METHOD OF MAKING SAME

BACKGROUND AND SUMMARY OF THE INVENTION

The present invention relates to reclosable plastic bags and to the lips commonly provided above the closures of such bags for grasping and opening the bags. More particularly, the invention relates to bags of the type disclosed in commonly-assigned U.S. Pat. No. 5,009,828 (the '828 patent) to McCree, wherein "grip strips" are formed on the lips for aiding the consumer in grasping and opening the bags.

In the bags described in the '828 patent, the grip strips on either lip of the bag are comprised of a plurality of small ridges spaced apart in parallel relationship and extending over the width of the bag, with the ridges individually having in one embodiment generally triangular cross-sections. While these bags perform on a par generally with conventional bags not having grip strips on the lips thereof, it has been noted that bags bearing grip strips tend in some instances to have an area of weakness immediately adjacent the lip sidewelds. The lip sidewelds, while satisfactory, could thus be improved.

The present invention arises out of the discovery that by modifying the cross-sectional configuration of the ridges as they are formed, the area of weakness can be eliminated and lip sidewelds of improved strength can result. In this modified cross-section, the ridges have a generally triangular base which is surmounted by a bulbous portion. The bulbous portion provides additional polymer at the tip of the ridge, so that when the tips of the ridges on one sidewall are brought near or into contact with the opposed sidewall in forming the lip sideweld, additional polymer is presented for bonding one lip to another in the area immediately adjacent the sideweld proper. As a result, the overall bond or weld between the lips is strengthened. The present invention is better understood, however, by considering the attached drawings and description.

BRIEF DESCRIPTION OF THE DRAWINGS

FIG. 1 is a cross-sectional view of ridges as they are formed adjacent the lip of a plastic bag in accordance with the teachings of U.S. Pat. No. 5,009,828 to McCree, with the ridges having been modified in a preferred embodiment of the present invention.

FIG. 2 is a cross-sectional view of opposed bag film web portions carrying ridges of the type described in U.S. Pat. No. 5,009,828, the opposed bag film web portions being shown in position for being transversely sealed to one another.

FIG. 3 is a cross-sectional view of the same bag film portions depicted in FIG. 2 with the ridges carried thereon, however, being modified in the manner of FIG. 1.

FIG. 4 is an enlarged cross-sectional view of one of the modified ridges of FIG. 1.

DETAILED DESCRIPTION OF THE PREFERRED EMBODIMENTS

Referring now to the drawings, and more particularly to FIG. 1, a preferred embodiment of the modified grip strip of the present invention is illustrated and designated generally by the numeral 10.

Each ridge 12 of the grip strip 10 is comprised as indicated previously of a lower generally triangular portion 14 which extends from a lip 16 of a bag (not shown), and of an upper bulbous portion 18 which is defined generally at the apex of the generally triangular portion 14. The upper bulbous portion 18 is placed in position, then, to contact and form a bond with an opposite lip 16 as more fully described hereafter (see FIG. 3).

The lower triangular portion 14 is preferably in the form generally of an isosceles triangle. The upper bulbous portion 18 is preferably of a generally circular cross-section and is preferably centered at the apex or along the centerline generally of the lower triangular portion 14, so that the modified ridges 12 in a preferred form can be envisioned as resulting from the superimposition of a circle of a selected radius on an isosceles triangle.

In terms of the manner of making ridges 12 with such a configuration, the methods by which triangularly-shaped ridges may be placed on plastic bags of the type to which this invention relates are generally well known to those skilled in the art, and it is considered that it will be a relatively simple matter for one skilled in the art to modify these methods to make the modified ridges described herein. For example, making the modified ridges 12 may simply involve drilling holes of a particular radius at the tips of the cut-outs used in the '828 patent for making the ridges of such patent, or at the tips of other cut-outs which may have been used previously for placing generally triangularly-shaped ridges on bag film webs.

The general construction and manner of making the ridges 12 are thus comparatively straightforward and do not require extensive discussion. One aspect of the ridges' manufacture which does merit additional discussion concerns the width of the actual profile plate opening (not shown) for producing the ridges 12 at the locations suggested by $d_1$ and $d_2$ in FIG. 4. The width of the profile plate opening corresponding to the intersection of the lower triangular portion 14 and bulbous portion 18 of a ridge 12 is to be understood as being given by $d_1$, while the width of the actual profile plate at the base of the lower portion 14 is understood as being given by $d_2$.

If the profile plate is cut so that $d_1$ is made too small relative to $d_2$, then polymer for the ridges 12 tends not to flow into the part of the profile plate corresponding to the bulbous portion 18, and a ridge results which has a more conventional generally triangularly-shaped cross-section or in which the bulbous portion 18 is too small to be of value in improving the lip sideweld strength. In either case, sufficient additional polymer is not presented at the tip of a ridge for bonding to an opposite lip, and no improvement in lip sideweld performance is seen.

If $d_1$ is on the other hand made too large relative to $d_2$, then the bulbous portion 18 becomes too large relative to the lower portion 14 supporting it, and the resulting ridges may not provide an adequate gripping surface. The proper dimensions $d_1$ and $d_2$ in the profile plate will achieve for a particular material of manufacture both a sufficient stiffness in the ridges 12 to provide a good gripping surface, and a suitably augmented tip of a ridge 12 for providing improved sidewelding.

This improved sidewelding property is illustrated well in comparing FIGS. 2 and 3. In FIG. 2, two opposed lips 20 and 22 bearing ridges 24 and 26, respectively, of the type described in the '828 patent are in position for sidewelding. It can be seen from FIG. 2 that the area in actual contact between the ridges 24 and 26 and the lips 22 and 20 opposite such ridges, respectively, (and thus the amount of polymer available for forming a bond between a ridge and an opposite lip) is very small. While the area in contact is not important at the sideweld itself because the pressures and heat of sealing effectively eliminate any gap between the lips 20 and 22, at some point as one moves away from the sideweld a gap remains, and the lips 20 and 22 are effectively bound together only through an area of contact such as shown in FIG. 2. This limited contact between the ridges 24 and 26 and the lips 22 and 20 opposite the ridges is believed to be responsible for the areas of weakness observed in some instances adjacent the lip sideweld.

By adopting a modified structure for the ridges on a lip as taught by the present invention, however, the amount of polymer available for bonding a ridge and an opposite lip is increased as seen in FIG. 3. This additional polymer at the tips of ridges 12' and 12'' is able to spread over and bond with a much larger area of the lips 16'' and 16' opposite ridges 12' and 12'', respectively, on formation of the adjacent sideweld. A sideweld of improved strength results.

While preferred embodiments of the modified grip strips of the present invention have been described herein, it will be appreciated that numerous changes may be made to such embodiments which are still fairly within the scope of the present invention as defined by the appended claims. For example, ridges 12 of a more general tapering quality might be modified in the manner suggested herein and also achieve a measure of improved lip sideweld strength.

What is claimed:

1. A reclosable plastic bag having two lips and including a grip strip on at least one of the two lips of the bag, the grip strip comprising a plurality of spaced apart ridges extending generally parallel to one another over the width of the bag on the at least one lip of the bag, wherein at least one of the ridges of the grip strip is characterized in cross-section by a lower generally triangularly-shaped portion and by an upper bulbous portion defined generally at an apex of the lower generally triangularly-shaped portion, said lower generally triangularly-shaped portion having a width, $d_1$, corresponding to the intersection of the lower generally triangularly-shaped portion and the bulbous portion and a width, $d_2$, corresponding to the base of the lower generally triangularly-shaped portion wherein $d_1$ is smaller relative to $d_2$ and the dimensions of $d_1$ and $d_2$ are selected to achieve sufficient stiffness in the ridge for providing a good gripping surface and a suitably augmented tip of the ridge for forming an improved lip sideweld when compared to a triangularly-shaped portion ridge without a bulbous portion.

2. A reclosable plastic bag as defined in claim 1, wherein the lower generally triangularly-shaped portion and the upper bulbous portion of the ridge give the appearance of an isosceles triangle having a circle superimposed upon the triangle and centered along the centerline of the triangle.

3. A reclosable plastic bag as defined in claim 2, wherein the lower generally triangularly-shaped portion and the upper bulbous portion of the ridge give the appearance of an isosceles triangle having a circle superimposed upon the triangle and centered generally at the apex of the triangle.

4. A reclosable plastic bag as defined in claim 1, wherein the two lips of the bag include a grip strip.

5. A reclosable plastic bag as defined in claims 1, 2, 3 or 4, wherein each of the plurality of spaced apart ridges is characterized by a lower generally triangularly-shaped portion and by an upper bulbous portion defined generally at an apex of the lower generally triangularly-shaped portion, said lower generally triangularly-shaped portion having a width, $d_1$, corresponding to the intersection of the lower generally triangularly-shaped portion and the bulbous portion and a width, $d_2$, corresponding to the base of the lower generally triangularly-shaped portion wherein $d_1$ is smaller relative to $d_2$ and the dimensions of $d_1$ and $d_2$ are selected to achieve sufficient stiffness in the ridge for providing a good gripping surface and a suitably augmented tip of the ridge for forming an improved lip sideweld when compared to a triangularly-shaped portion ridge without a bulbous portion.

* * * * *